United States Patent [19]

Anderson

[11] Patent Number: 4,739,337

[45] Date of Patent: Apr. 19, 1988

[54] MOBILE MECHANICALLY STEERABLE SATELLITE TRACKING ANTENNA

[75] Inventor: Roy E. Anderson, Scotia, N.Y.

[73] Assignee: Mobile Satellite Corporation, Malvern, Pa.

[21] Appl. No.: 774,154

[22] Filed: Sep. 9, 1985

[51] Int. Cl.[4] ..... H01Q 1/27; H01Q 3/08; H01P 5/02

[52] U.S. Cl. ..... 343/882; 333/261; 343/711; 343/905; 343/906

[58] Field of Search ..... 333/236, 245, 260, 261; 343/705, 706, 708–714, 756–759, 763, 820, 839, 872, 878, 882, 906, DIG. 2, 905; 342/350, 354, 359, 367–375, 352

[56] References Cited

U.S. PATENT DOCUMENTS 3,681,714 8/1972 Terakawa ..... 333/254

FOREIGN PATENT DOCUMENTS 0029201 2/1983 Japan ..... 343/878

*Primary Examiner*—Marvin L. Nussbaum

*Attorney, Agent, or Firm*—Charles W. Helzer

[57] ABSTRACT

A mobile, mechanically steerable satellite tracking antenna is described which employs a short vertically positioned length of coaxial cable bent at its upper end to an elevation angle setting at which the antenna is to be pointed. The flexible coaxial cable length carries a connector at its upper flexible end for quick connect-/disconnect to an antenna element and reflector (if required). A rotatable mounting device is provided for supporting a fixed end segment of the flexible cable in a rotationally fixed position and carries an extended supporting arm at the end of which a sealed bearing unit rotatably supports the free flexible end of the cable which is bent to a desired elevation angle. The supporting arm with attached bearing unit and rotationally free but captured flexible free end of the cable is mounted on the outer housing of the mounting device and is rotationally driven by a reversible stepping or other motor via a gear train. The flexible cable passes through the center of the top of the housing through an upper O-ring seal and a lower bushing and is supported in a manner such that the fixed end flexible cable does not twist or turn on its axis as the rotatable housing and supporting arm are turned in azimuth but rather flexes along its length in order to accommodate the required elevational setting at a desired azimuth angle.

17 Claims, 2 Drawing Sheets

MOBILE MECHANICALLY STEERABLE SATELLITE TRACKING ANTENNA

FIELD OF INVENTION

This invention relates to a new and improved mobile, mechanically steerable, satellite tracking antenna that facilitates the provision of mobile radio communication services that are distance insensitive, and makes such services available everywhere within the footprint of a satellite except where objects such as building, mountains, etc. block the path between the satellite and a mobile unit.

More specifically, the invention relates to a mobile, steerable, satellite tracking antenna that is small in size, simple in construction, low cost and reliable in operation, and aesthetically acceptable for use on vehicles of many types, including private automobiles.

BACKGROUND OF INVENTION

Prior known mechanically steered antennas for use in mobile satellite communication systems have employed rotary connectors for coupling the signal supply cable from a radio receiver/transmitter communication system to the antenna. Alternatively, a loop of cable for the same purpose is employed. However, rotary connectors are expensive and tend to generate electrical noise in the radio frequency band while in use. Although rotary connectors subject to the above-discussed shortcomings are capable of full 360 degree rotation in azimuth, coiled cable loops allow an antenna to rotate only a few times before the direction of the rotation of the antenna must be reversed to untangle the coiled loop. Cable loops also take up more room than rotary couplers and in addition tend to become noisy after the cable has been flexed and unflexed many times.

In addition to the above disadvantage, prior steerable antennas for tracking satellites on small mobile units usually require that the entire antenna system, including the antenna itself, be enclosed in a radome. This increases the size and mass of the antenna as well as wind resistance since the radome must enclose the total space occupied by the antenna as it rotates throughout all azimuth directions. This results in an antenna system which is bulky, provides considerable wind resistance to vehicles on which such radomes are mounted, and is not pleasing in appearance.

To overcome the above objectionable features of known prior art steerable satellite tracking antennas for use on mobile units such as trucks, vans, cars, boats and the like, the present invention was devised in which a principle purpose of the invention is to eliminate the need for a coiled cable loop or a rotary joint and the need for enclosure of the antenna in a radome as has been done in the past.

SUMMARY OF INVENTION

It is therefore a primary object of the present invention to provide a mobile, steerable, satellite tracking antenna and mounting therefor that is small in size, simple in construction, low cost and reliable in operation as well as aesthetically acceptable for use on vehicles of many types including private automobiles.

Another object of the invention is to provide such a mobile, steerable satellite tracking antenna and mounting therefor which is capable of bi-directional azimuth rotation continuously through 360 degrees of movement in either direction at a chosen elevational setting within an elevation range from 0 to 90 degrees and which obviates the need for rotary joints or wrapped cable coils.

Still another object of the invention is to provide such a steerable antenna which is motor driven in azimuth, as by a stepping motor, for "step track" or other steering based on received signal strength at a steering rate sufficient to keep the antenna beam pointed at a satellite at maximum turning rates of high speed vehicles upon which the mobile, steerable antenna is mounted.

A further object of the invention is the provision of such a mobile, steerable antenna and mounting therefor which is of a smaller size and general appearance that is more aesthetically appealing than presently available mobile steering antennas, but whose sale price is commensurate with competitive mobile, steering antennas. Further, installation of the antenna and mouting is easily accomplished in a manner similar to known types of mobile, tracking antennas, such as by being secured to a trunk lid or other top surface of a motor vehicle by thru bolts and nuts, clamps, magnetic attachment méans and the like.

Still a further object of the invention is to provide a mobile, steerable antenna possessing all of the above-listed features which is capable of operation in weather conditions experienced in all except the most extreme conditions of icing and cold, without requiring the use of a radome or other similar bulky enclosure, and having an operating lifetime of several years without developing RF noise in the received band when using a low noise figure receiver (1 dB or lower).

In practicing the invention, a mechanically steerable mobile satellite tracking antenna and mounting therefor is provided which comprises a short length of flexible cable designed for operation within predetermined communications frequency bands. Rotatable cable support means are provided for supporting one end segment of the flexible cable in a fixed position relative to a mobile mounting surface on which the antenna is supported. The rotatable cable support means is rotatable in azimuth relative to the fixed end segment of the flexible cable which is non-rotatable about its own axis relative to the rotatable cable support means and the mounting surface. A cable end elevation setting support arm is secured to the top of the rotatable cable support means and rotatable therewith. Cable bearing support means are secured to the remaining free end segment of the cable and elevation setting support arm for rotationally supporting the free end segment of the flexible cable which extends exteriorly of the rotatable cable support means at a desired elevation angle setting. The device is completed by antenna drive means coupled to the rotatable cable support means for rotating the cable support means in azimuth along with the free end segment of the flexible cable which is captured by and rotationally supported within the bearing support means secured to the free end of the elevation setting support arm whereby the upper free end of the flexible cable is allowed to track the movement in azimuth of the rotatable cable support means through a relatively mild flexing action while remaining rotationally fixed without rotation about its own axis.

In preferred embodiments of the invention, the flexible cable support means is rotatable continuously in either direction through a full 360 degree or more azimuth angle. In addition the cable end elevation setting support arm is adjustable to provide for adjustment of the elevation angle setting of the free end of the flexible cable through an elevation angle range of from 0 to 90 degrees. In practical embodiments of the invention, suitable connectors are secured to the end of the free end segment of the flexible cable and to the end of the fixed end segment of the cable supported in the rotatable cable support means for facilitating ready, quick-connect/disconnect of the flexible cable to an antenna and to the input/output of a first stage preamplifier of a communications receiver and/or the output driver stage of a communications transmitter, respectively, for receiving/transmitting satellite signals via the antenna.

In preferred embodiments of the invention, the antenna drive means comprises a stepping motor or other motor that is reversible coupled to the rotatable cable support means via suitable coupling gears for step-track or other steering of the antenna based on received signal strength at a steering rate sufficient to keep the antenna beam pointed at a satellite at maximum turning rates of a mobile vehicle on which the antenna is mounted.

Preferrably, the steerable antenna is mounted to a mobile vehicle by a base member secured by a readily attachable means, such as magnets, clamps, thru-bolts or the like, to the top of the vehicle. The base member has a central hollow tubular portion in which the flexible cable is vertically positioned and which is surrounded by a rotatable can-shaped housing member on which the support arm for the free end of the flexible cable is secured. A first stage pre-amplifier of a radio receiving set and/or the driver output amplifier stage of a transmitter set preferably are mounted within the base member and/or the rotatable can-shaped housing in a weather-tight manner.

BRIEF DESCRIPTION OF DRAWINGS

These and other objects, features and many of the attendant advantages of this invention will be appreciated more readily as the same becomes better understood from a reading of the following detailed description, when considered in connection with the accompanying drawings, wherein like parts in each of the several figures are identified by the same reference character, and wherein.

BEST MODE OF PRACTICING THE INVENTION

Figure 1:
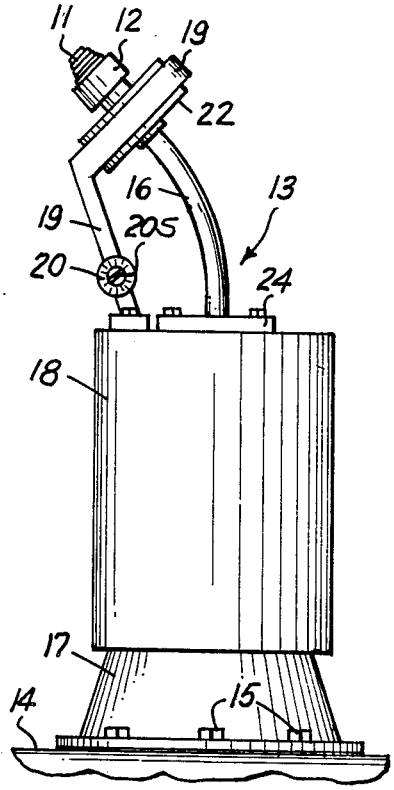
FIG. 1 is a fragmentary elevational view of a new and improved mobile, mechanically steerable, satellite tracking antenna mounted on a mobile vehicle and constructed according to the invention.

FIG. 1 is a fragmentary, elevational view of a new and improved, mechanically steerable, mobile satellite tracking antenna constructed according to the invention. In FIG. 1, an antenna is shown partially at 11 and is designed for operation in the communications frequency band with which the antenna system is to be used. The antenna 11 may comprise a coiled helix, a yagi, a crossed yagi or other known highly directional antenna of conventional, commercially available construction. Leads (not shown) from the antenna element 11 are fed out through a suitable connector such as a snap-action, quick-connect/disconnect connector shown at 12 for ready securement (or detachment) to a mechanically steerable, satellite tracking antenna mounting device shown generally at 13, constructed according to the invention. Mounting device 13 is secured to an upper mounting surface of a mobile vehicle, shown partially at 14, by known easily applied securement means such as thru-bolts 15 and nuts, permanent magnet mountings, snap-on latches and hooks, and the like, whereby the antenna mounting device 13 readily and securely may be mounted on a mobile vehicle.

Figure 2:
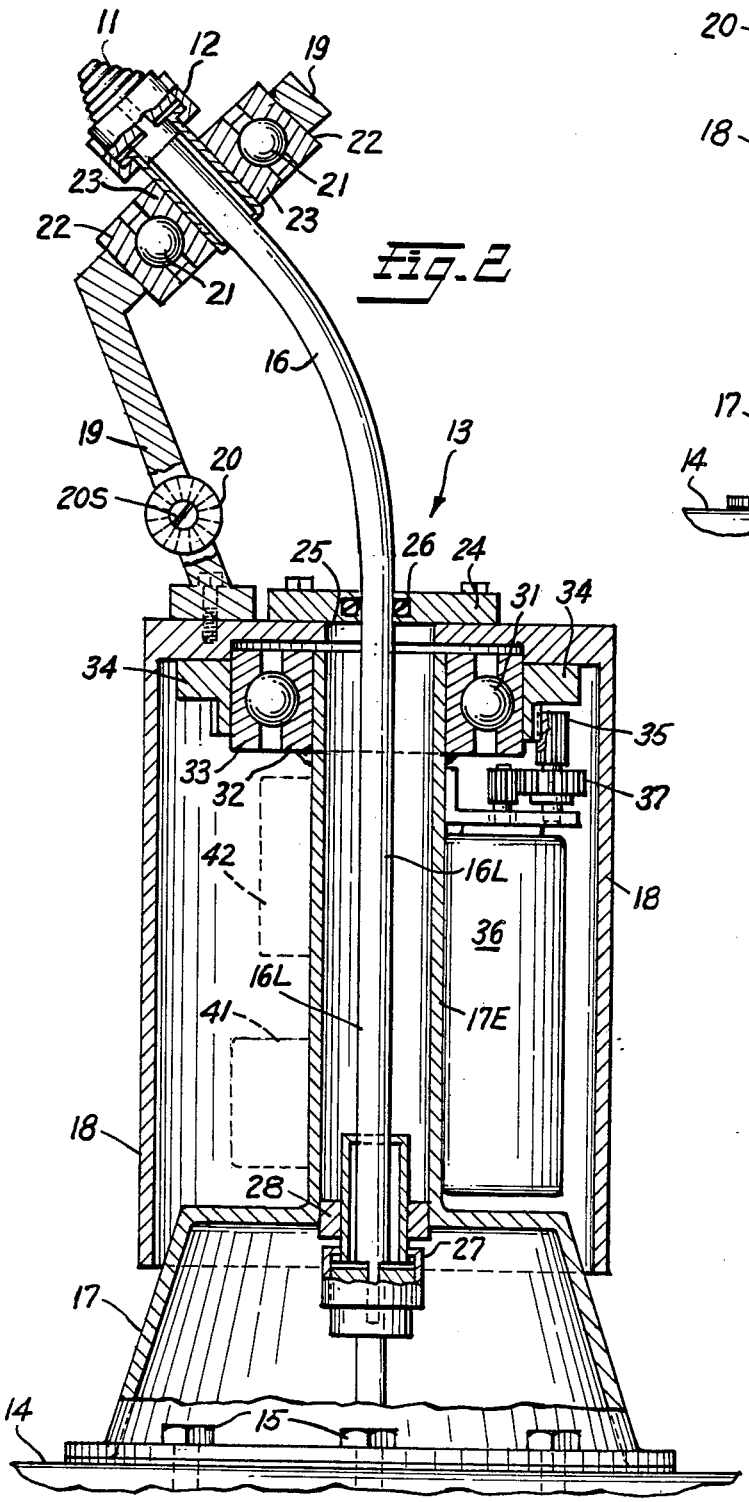
FIG. 2 is an enlarged, fragmentary vertical sectional view, partly in elevation, taken through FIG. 1 and showing the details of construction of the novel, mechanically steerable, antenna mounting device comprising the invention, and shows the same secured to the top of a mobile vehicle.

The mechanically steerable antenna mounting device 13 is best illustrated in FIG. 2, and comprises a short length of flexible cable 16 which is designed for operation within the predetermined band of communications frequencies, such as the VHF, the UHF, the L-band or other similar frequency bands used for communication purposes. The flexible cable 16 serves to supply communication frequency signals both to the antenna element for transmission to a communication satellite, and for feeding received signals from the satellite tracking antenna back down to a communications receiving set as will be described hereafter. For this purpose, cable 16 preferably comprises a coaxial cable which is commercially available, and selected for its ability to withstand repeated or continuous flexing along its longitudinal axis for prolonged periods without becoming electrically noisy.

The flexible cable 16 has only a short length, of the order of a few inches, and is supported within the rotatable cable support means comprising part of the antenna mounting device 13. The rotatable cable support means is comprised by a generally cylindrical, hollow base member 17 secured to the mounting surface 14 of a vehicle by thru-bolts 15 and nuts or other similar readily-used securement means. Base member 17 has a closed, circular-shaped upper end with a central opening therein around which an upwardly extending, elongated, central hollow tubular extension portion 17E is formed. The lower segment 16L of flexible cable 16 is supported in a vertically disposed position within the tubular extension portion 17E of base member 17. The rotatable cable support means is further comprised by an inverted, cylindrical, elongated can-shaped, hollow, rotatable housing member 18 rotatably mounted on the upper end of the central hollow tubular extension portion 17E of base member 17.

A cable end elevation setting support arm 19 is secured to the top peripheral edge at one side of the rotatable housing 18. The upper end of supporting arm 19 has cable bearing support means secured therein in the form of a sealed, weather-tight ball bearing set 21 having its outer race 22 secured to the upper free end of the support arm 19. The upper free, flexible end of cable 16 having the connector 12 attached thereto, is secured within the inner race 23 of the ball bearing set 21 so as to be allowed to rotate freely relative to supporting arm 19. By adjustment of the length of the support arm 19, as described hereafter with relation to FIG. 3, it will be appreciated that the free flexible end of cable 16 can be adjusted through an elevation angle of from 0 to 90 degrees elevation setting.

The short length of flexible cable 16 is led from the flexible end thereof that is rotationally supported within the bearing means 21 at the end of support arm 19 through a central opening in a weather-tight cover member 24 that closes a central opening 25 in the top of rotatable, can-shaped housing member 18. The central opening in cover member 24 is aligned with the hollow opening in the central tubular extension 17E of base member 17. To maintain the top of the housing member 18 weather-tight, a suitable O-ring seal 26 is provided between the flexible cable 16 and the central opening in the cover member 24. The lower segment or portion 16L of the flexible cable is led through hollow interior of the tubular extension 17E of base member 17 and terminates in a second connector 27 secured to the lower end of cable 16 and supported in the lower open end of tubular extension portion 17E by means of a bushing 28. The connector 27 is designed for ready, quick-connect/disconnect to the pre-amplifier stage of a suitable communications receiver and/or to the output driver stage of a communications transmitter via a suitable coupling arrangement (not shown), if required.

From the above brief description, it will be appreciated that as the outer rotatable housing member 18 is rotated (by means to be described hereafter), it carries with it the cover member 24, the O-ring seal 26 and the supporting arm 19 together with the ball bearing support means 21 and the flexible outer end of cable 16 together with the attached connector 12. The rotation of housing member 18 carrying the end of the flexible cable 16 therefore changes the azimuth setting of the antenna 11 secured to the end of flexible cable 16 via connector 12. It should be noted at this point in the description that changing the azimuth direction of the antenna and free flexible end of cable 16 in the above-described manner only results in a mild bending or flexing action of the free flexible end of cable 16 as the azimuth angle changes. This is due to the fact that the inner race 23 of the ball bearing set 21 in which the free end of the cable 16 is secured, is free to rotate within the bearing unit 21 so that the cable 16 does not twist or turn on its axis, but merely flexes along its length in whatever direction is required by the changed azimuth setting. The flexible cable 16 does not, however, rotate about its own axis relative to the base member 17 of vehicle mounting surface 14 to which the antenna mounting is secured. Thus, flexible cable 16 is not subjected to rotational shearing action but only to a mild flexing to whatever elevational angle setting is made by support arm 19. Because the flexible cable 16 is designed to sustain repeated flexing along its longitudinal axis, it is capable of continuous rotational setting of new azimuth directions over long periods of usage while providing reliable signal coupling to and from the antenna element.

In fabricating an antenna mounting device according to the invention, the base member 17 and rotatable housing 18 can be of any design and size typical of mobile radio antenna mountings and the means to attach it to the top of a vehicle can be thru-bolts 15 as shown, permanent magnet mountings, clamps or the like, whereby installation of the mounting device on a vehicle can be quick, inexpensive and secure. The center post or tubular extension 17 may be welded or otherwise made an integral part of the base member 17 in a manner such that the tubular extension 17 is capable of withstanding wind loading effects and other normal strains to which mobile antenna structures are subjected. The tubular extension 17 preferably has an inside diameter sufficiently large to pass the coaxial connectors 12 and 27 so as to facilitate removal, servicing and replacement of the flexible cable 16 should it become worn after an extensive period of use. As noted earlier, the flexible cable 16 is selected particularly for its ability to withstand flexing. Since it is short, it does not have to be specially designed for low loss. The cable 16 is retained in the center of the hollow tubular extension 17E by the removable bushing 28 at its lower end and by the O-ring seal 26 set in the removable cover member 24 at its upper end. The bushing 12, preferably should not completely close the bottom of the hollow tubular extension portions 17E so that any moisture formed by condensation, etc., can drain from the tubular support extension. The O-ring seal 26 seals the top of the tubular support extension 17E so as to resist the entry of moisture and at the same time allows the cover member 20 and top of the can-shaped housing member to be rotated while the flexible cable member 16 remains fixed and does not rotate about its axis.

To provide rotation of the rotatable, cup-shaped housing member 18 and attached supporting arm 19 in the above-described manner, a second, sealed ball bearing unit 31 is included which has its inner race 32 attached to the outer end peripheral surface of the upper end of the hollow tubular extension 17E of base member 17. The outer race 33 of bearing unit 31 supports a ring gear 34 that is secured to the bottom surface of the top of housing member 18 and meshes with a pinion drive gear 35 driven by a motor 36 through a coupling gear train 37. The drive motor 36 is mounted on the exterior surface of the hollow tubular extension 17E of base member 17. As motor 36 turns, it drives the ring gear 34 rotationally through the pinion gear 35 and coupling gear train 37. Ring gear 34 because it is secured not only to the outer race 33, but also is secured to the botom surface of the top of can-shaped housing member 18, imparts rotational movement to housing member 18 through bearing set 31. This results in rotation in azimuth of the housing 18, the weather-tight, removable cover 24, the O-ring seal 26 which turns about the lower, vertically positioned segment 16L of the flexible cable, the supporting arm 19 including the sealed outer ball bearing unit 21 secured to the end of support arm 19 and the free flexible end of cable 16 to which the antenna 11 is secured via the cable connector 12.

The upper free end of flexible cable 16, which preferably is a coaxial cable of short length, together with the attached antenna, is tilted from the vertical by the amount set by the adjustable length of supporting arm 19. In FIG. 1, the angle of elevation is illustrated to be about 45 degrees, but any elevation angle within the range of 0 to 90 degrees is possible. Thus, as motor 36 turns the outer housing member 18, it causes the supporting arm 19 with the rotationally free but captured flexible end of cable 16 to sweep about the vertical axis of the device (vertical axis of the vertically-positioned segment 16L), and changes the azimuth pointing of the antenna attached to the end of cable 16 via connector 12. As the azimuth angle changes, the inner race of the sealed bearing unit 21 rotates so that the cable 16 remains stationary about its own axis and does not twist or turn on its axis in a shearing manner, but merely flexes along its longitudinal axis in a desired azimuth setting direction in a manner for which it is specially designed.

Figure 3:
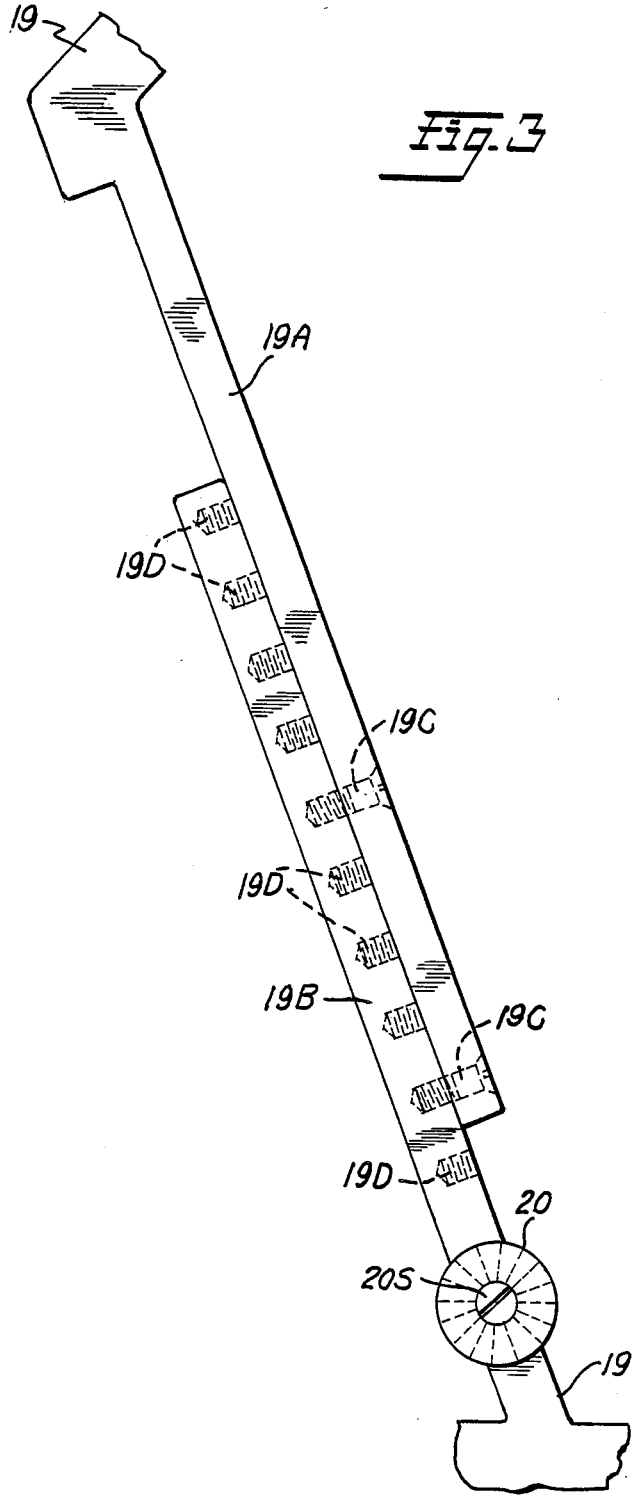
FIG. 3 is an enlarged, fragmentary side view of an adjustable supporting arm employed on the steerable antenna mounting device of FIGS. 1 and 2 whereby the elevation setting of an antenna used according to the invention, readily can be adjusted.

FIG. 3 of the drawings is an enlarged, fragmentary view of an adjustable portion of the supporting arm 19, and illustrates how the length of supporting arm 19 can be adjusted to provide stepped increases or decreases in the elevation angle setting of the free flexible end of cable 16 and the antenna element secured to its free end. For this purpose, the supporting arm 19 includes a swivel joint 20 at its base which may be set to any desired elevation angle between 0 and 90 degrees by simply loosening a set screw 20S, adjusting the arm 19 to the desired elevation angle setting and retightening the set screw. To accommodate the fixed length of flexible cable 16 over the range of elevation angle settings, it is necessary to make minor adjustments to the length of the support arm 16. For this purpose, support arm 19 is separated about midway its length into two mating, complementary, telescoping parts 19A and 19B. Parts 19A and 19B can be slid longitudinally with respect to each other in order to bring into alignment set screws 19C seated in the portion 19A with threaded screw openings 19D formed in the complementary, mating part 19B. By tightly screwing in the set screws 19C into a preselected set of threaded openings 19D, the length of the support arm 19 readily can be adjusted to accommodate a desired elevation angle setting. It should be understood that once the elevational angle setting has been adjusted in this manner, it cannot be changed, in the device illustrated, without stopping the device and manually adjusting the setting of the support arm. If a continuous adjustment is desired, or for that matter an automatically adjusting elevation angle setting is desired, while the device is operating, such adjustment can be provided by designing the complementary mating parts 19A and 19B to slide together continuously in a bayonet slide-action manner and provide separate reversible drive motors within the outer housing member 18 to drive the swivel 20 and adjustable arm portions 19A and 19B in a manner known to those skilled in the art of adjustable length positioning arm design.

The reversible gear drive motor 36 preferably comprises a reversible stepping motor for step-track steering of the antenna element coupled to the free flexible end of cable 16 via the ring and pinion gear 30 and coupling gear 37. A preferred arrangement is to employ a low noise figure receiver preamplifier (1 dB or lower) shown in dotted outline form at 41 mounted within the rotatable housing member 18 on the fixed tubular extension portion 17E of base member 17. The receiver output can be proportionally amplifier and then fed back to drive the stepping drive motor 36 in order to provide step-track or other steering of the antenna element based on the received signal strength at a preset steering rate for the steering drive motor which is sufficient to keep the antenna beam pointed at a satellite at maxium turning rates of a mobile vehicle on which the antenna is mounted.

In addition to the receiver 41, the space provided within the housing member 18 is sufficiently large to additionally mount a radio transmitter unit or at least the output power drive amplifier of a transmitter unit shown at 42 for those equipments where it is desired to use the antenna not only for receiving signals transmitted by satellite, but also to communicate back through the satellite to another ground installation. For such equipment, it would be necessary to provide suitable coupling devices such as a diplexer (not shown) for connecting the receiver 41 and the transmitter 42 to the antenna element via the flexible cable 16 and connectors 12 and 27. The receiver preamplifier 41 (or alternatively the receiver itself), and/or the transmitter output stage 42 (or alternatively the transmitter itself), both of which are designed for use within a communication band of frequencies such as the VHF, UHF, L-band or higher, can be supported within the rotatable housing 18 as shown, or they can be mounted within the base member 17, or both the housing and base member 17, provided that appropriate weather-tight sealing of the interior of either or both the housing 18 and base member 17, is provided. By such arrangements, the supply cable or conductors that connect between the flexible cable connector 27 to the receiver and/or transmitter unit inputs can be made to be quite short and of ordinary mobile quality.

A mobile, mechanically steerable satellite tracking antenna mounting device constructed in the above described manner is easily and inexpensively repaired or provided with replacement parts. As noted previously, the antenna element itself is detachable. If it is damaged in service by rocks or stones thrown from the road, it easily can be removed and replaced via connector 12. The flexible cable 16 preferably is a short section of conventional, commercially available coaxial cable that is designed from repeated flexing along its axial length. The short length of cable 16 may be only a few inches long with a connector on either end. It too can be replaced quickly and easily in case of damage or in the event that after extensive useage the flexible cable becomes electrically noisy. As noted earlier, the hollow central tubular extension 17E of base member 17 has an inside diameter which is sufficiently large to pass the coaxial cable 16 and the coaxial connector 12 or 26 on either end of the cable. In the embodiment of the invention shown, the connector 12, for example, can easily be detached from the upper flexible end of cable 16, the cable pulled out from the bottom through base member 17, and a new cable installed. Alternatively, the center race of the first or upper sealed bearing set 21 can be made large enough to pass the connector 12. With such a design, the lower bushing 28 would be removed and the removable cover member 24 and O-ring seal 26 made a part of the cable replacement unit.

Preferably, a circularly polarized antenna 11 such as the helix shown, a yagi, crossed yagi, or the like, element (not shown in FIGS. 1 or 2), is attached to the upper flexible end of cable 16 via the connector 12. If desired, or experience proves it to be necessary, additional mechanical support may be made to the inner race 23 of the sealed bearing set 20 to assure that it is adequately sturdy to withstand wind loading, inertia effects, and the like, particularly if a small reflector disk is employed with the antenna. By this means, the need for a radome or other bulky outer protective housing for the entire antenna and the support system is obviated.

From the foregoing description, it will be appreciated that the invention provides a new and improved mobile, mechanically steerable, satellite tracking antenna and mounting therefor that is small in size, simple in construction, low cost and reliable in operation as well as aesthetically acceptable for use on vehicles of many types including private automobiles. The novel antenna system provides for continuous bi-directional azimuth rotation which is continuous in either direction at either a fixed elevation setting or at any desired elevation setting from 0 to 90 degrees. The antenna can be either continually operated or motor driven in azmmuth by use of a stepping or other reversible drive motor for "step track" or other steering based on received signal strength at steering rates which are sufficient to keep the antenna beam pointed at a satellite at maximum turning rates of high speed vehicles. The size and general appearance of the antenna system is commensurate or better than that of other types of mobile antenna and can be installed with readily attachable securing means such as thru-bolts and nuts, clamps or magnetic mounting elements and the like to the roof, or trunk or other surface of an automobile or other vehicle. Further, since it is self-contained and weather-tight, the sales price of the mounting is commensurate with or less than other types of known steerable mobile communication system antenna mountings, many of which require radomes or other bulky protective structures which add to cost, weight, and bulk of the system. Despite the fact that it does not require a radome or other protective housing, the novel antenna system nevertheless is capable of operation in weather conditions experienced in all except the most extreme conditions of icing and cold. The design is such that the operating lifetime is over several years without requirement of replacement parts due to generation of RF or electric noise in the received band when using a low noise figure receiver.

INDUSTRIAL APPLICABILITY

This invention provides a low cost, simple to construct, small sized and reliable antenna and mounting system therefor for use with mobile unit mounted satellite tracking communication systems in order to provide mobile radio services that are distance insensitive and are available everywhere within the footprint of a communication satellite except where an object such as a mountain or building blocks the path between the mobile unit and the satellite.

Having described a new and improved mobile, mechanically steerable satellite tracking antenna and mounting device therefor according to the invention, it is believed obvious that other modifications and variations of the invention will be suggested to those skilled in the art in the light of the above teachings. It is therefore to be understood that changes may be made in the particular embodiment of the invention described which are within the full intended scope of the invention as defined by the appended claims.

What is claimed is:

1. A mechanically steerable mobile satellite tracking antenna comprising a short length of flexible cable designed for operation within a predetermined band of communication frequencies, rotatable cable support means for supporting one end segment of the flexible cable in a fixed position relative to a mobile mounting surface on which the antenna is to be supported, said cable support means being rotable in azimuth relative to the fixed end segment of the flexible cable which is non-rotatable about its own axis relative to the rotatable cable support means and the mounting surface, a cable end elevation setting support arm secured to the top of the rotatable cable support means and rotatable therewith, cable bearing support means secured to the free end of said cable end elevation setting support arm for rotationally supporting the remaining free end segment of the flexible cable which extends exteriorly of the rotatable cable support means at a desired elevation angle setting, and antenna drive means coupled to said rotatable cable support means for rotating the cable support means in azimuth along with the free end segment of the flexible cable which is captured by and rotationally supported within the bearing support means secured to the free end of the elevation setting support arm whereby the upper free end segment of the flexible cable is allowed to track the movement in azimuth of the rotable cable support means through a relatively mild flexing action while remaining rotationally fixed relative to and without rotation about its own axis.

2. A steerable antenna according to claim 1 wherein the cable support means is rotatable continuously in either direction through a full 360° or more azimuth angle.

3. A steerable antenna according to claim 1 wherein the cable end elevation setting support arm is adjustable to provide for adjustment of the elevation angle setting of the free end of the flexible cable through an elevation angle range of from 0° to 90°.

4. A steerable antenna according to claim 2 wherein the cable end elevation setting support arm is adjustable to provide for adjustment of the elevation angle setting of the free end of the flexible cable through an elevation angle range of from 0° to 90°.

5. A steerable antenna according to claim 4 further including connectors secured to the free flexed end of the flexible cable and to the lower end of the cable segment supported in the rotatable cable support means for facilitating ready, quick-connect/disconnect of the flexible cable to an antenna and to the input/output of a first stage preamplifier of a radio receiver and/or the output driver stage of a radio transmitter, respectively, for receiving/transmitting satellite signals via the antenna.

6. A steerable antenna according to claim 5 wherein the short length of cable is a coaxial cable adn the flexible cable, the antenna, and the receiver and/or transmitter all are operable over the VHF band or higher.

7. A steerable antenna according to claim 6 wherein the antenna drive means comprises a reversible stepping or other motor coupled to the rotatable cable support means via suitable coupling gears for step-track or other steering of the antenna based on received signal strength at a steering rate sufficient to keep the antenna beam pointed at a satallite at maximum turning rates of a mobile vehicle on which the antenna is mounted.

8. A steerable antenna according to claim 7 wherein the rotatable cable support means comprises a generally-cylindrical, hollow base member adapted to be mounted on a mounting surface of a mobile vehicle and having a circular-shaped closed upper end with a central opening therein over which an upper elongated central hollow tubular extension portion is centrally formed, the fixed end segment of the flexible cable being supported in a vertically disposed position within the hollow tubular extension portion of the base member, a second ball bearing set having its inner race secured to the outer circumferential edge of the upper open end of the hollow elongated tubular extension portion of the base member, and an inverted, cylindrical, elongated can-shaped, hollow, rotatable weather-tight housing member having a lower open protective skirt end circumferentially surrounding and protecting the base member including the tubular extension portion, said rotatable housing member having a substantially closed upper end secured to the outer race of the second ball bearing set and rotatable therewith around the elongated tubular extension portion of the base member, the upper end of the rotatable housing member having a central opening therein which is coaxial with the hollow interior of the upper tubular extension portion of the base member and through which the fixed end segment of the flexible cable passes, a weather-tight closure member closing the central opening through the top of the rotatable housing member and alligned upper open end of the hollow tubular extension portion and having a central sealed opening for accommodating passage of the fixed end segment of the flexible cable therethrough while allowing relative rotational movement between the rotatable housing member and the hollow tubular extension portion and lower portion of the base member, and a bushing supported within the lower open end of the hollow tubular extension portion of the base member through which the fixed end segment of the flexible cable passes into the lower portion of the base member.

9. A steerable antenna according to claim 8 wherein the cable end elevation setting support arm is secured to the top outer circumferential edge of the rotatable inverted can-shaped housing member and rotates therewith and is adjustable to allow the end of the flexible cable to be set any any desired elevation angle between 0° and 90°.

10. A steerable antenna according to claim 9 wherein the hollow base member and/or the rotatable can-shaped rotatable hollow housing member have supported therein in a weather-tight manner an input preamplifier to a satellite signal radio receiving system and/or the output driver stage of a satellite signal radio transmitting system for interconnection with a steerable antenna supported on the free flexible end of the flexible cable by suitable connectors, said antenna being rotatable in azimuth with the rotatable, housing member and adjustable in elevation by adjustment of the cable end elevation setting support arm.

11. A steerable antenna according to claim 10 wherein the output signal from the satellite signal radio receiving system is fed back to the stepping or other reversible motor for step-track or other steering of the antenna based on received signal strength at a steering rate sufficient to keep the antenna beam pointed at a satellite at maximum turning rates of the mobile vehicle on which the antenna is mounted.

12. A steerable antenna according to claim 1 further including connectors secured to the free flexed end of the flexible cable and to the lower end of the cable segment supported in the rotatable cable support means for facilitating ready, quick-connect/disconnect of the flexible cable to an antenna and to the input/output of a first stage preamplifier of a radio receiver and/or the output driver stage of a radio transmitter, respectively, for receiving/transmitting satellite signals via the antenna.

13. A steerable antenna according to claim 1 wherein the short length of cable is a coaxial cable operable over the VHF band or higher.

14. A steerable antenna according to claim 1 wherein the antenna drive means comprises a reversible stepping or other motor coupled to the rotatable cable support means via suitable coupling gears for step-track or other steering of the antenna based on received signal strength at a steering rate sufficient to keep the antenna beam pointed at a satallite at maximum turning rates of a mobile vehicle on which the antenna is mounted.

15. A steerable antenna according to claim 1 wherein the rotatable cable support means comprises a generally-cylindrical hollow base member adapted to be mounted on a mounting surface of a mobile vehicle and having a circular-shaped closed upper end with a central opening therein over which an upper elongated central hollow tubular extension portion is centrally formed, the fixed end segment of the flexible cable being supported within the hollow tubular extension portion of the base member, a second ball bearing set having its inner race secured to the outer circumferential edge of the upper open end of the hollow elongated tubular extension portion of the base member, and an inverted, cylindrical, elongated can-shaped, hollow, rotatable weather-tight housing member having a lower open protective skirt end circumferentially surrounding and protecting the base member including the tubular extension portion, said rotatable housing member having a substantially closed upper end secured to the outer race of the second ball bearing set and rotatable therewith around the elongated tubular extension portion of the base member, the upper end of the rotatable housing member having a central opening therein which is coaxial with the hollow interior of the upper tubular extension portion of the base member and through which the fixed end segment of the flexible cable passes, a weather-tight closure member closing the central opening through the top of the rotatable housing member and alligned upper open end of the hollow tubular extension portion and having a central sealed opening for accommodating passage of the fixed end segment of the flexible cable therethrough while allowing relative rotational movement between the rotatable housing member and the hollow tubular extension portion and lower portion of the base member, and a bushing supported within the lower open end of the hollow tubular extension portion of the base member through which the fixed end segment of the flexible cable passes into the lower portion of the base member.

16. A steerable antenna according to claim 15 wherein the cable end elevation setting support arm is secured to the top outer circumferential edge of the rotatable inverted can-shaped housing member and rotates therewith.

17. A steerable antenna according to claim 15 wherein the hollow base member and/or the rotatable can-shaped rotatable hollow housing member have supported therein in a weather-tight manner an input preamplifier to a satellite signal radio receiving system and/or the output driver stage of a satellite signal radio transmitting system for interconnection with a steerable antenna supported on the free flexbile end of the flexible cable by suitable connectors, said antenna being rotatable in azimuth with the rotatable, housing member and adjustable in elevation by adjustment of the cable end elevation setting support arm.

* * * * *